United States Patent [19]

Tanczyn

[11] 4,022,640

[45] May 10, 1977

[54] PROCESS FOR COLD-WORKING AND STRESS-RELIEVING NON-HEAT HARDENABLE FERRITIC STAINLESS STEELS

[75] Inventor: Harry Tanczyn, Baltimore, Md.

[73] Assignee: Armco Steel Corporation, Middletown, Ohio

[22] Filed: Mar. 26, 1975

[21] Appl. No.: 562,123

Related U.S. Application Data

[62] Division of Ser. No. 434,397, Jan. 18, 1974, Pat. No. 3,888,119.

[52] U.S. Cl. ..... 148/37; 148/12 EA; 148/11.5 R; 72/140; 267/166; 428/592

[51] Int. Cl.[2] ..... C22C 38/40

[58] Field of Search ..... 148/12 B, 12 E, 12 EA, 148/37, 135, 136, 38, 11.5 R; 75/128; 29/190, 193; 72/364, 371, 140

[56] References Cited

UNITED STATES PATENTS

| | | | |
|---|---|---|---|
| 2,527,521 | 10/1950 | Bloom | 148/37 X |
| 2,767,837 | 10/1956 | Nachtman et al. | 148/12 B |
| 3,389,991 | 6/1968 | Tanczyn | 148/37 X |
| 3,694,192 | 9/1972 | Brickner et al. | 148/12 EA |

OTHER PUBLICATIONS

Machine Design, Dec. 14, 1967, pp. 104–106.
Alloy Digest, SS–277 Stainless Steel, Aug. 1972, Engr. Alloy Digest Inc., Upper Montclair, N. J.
Bar and Allied Products, Met. Soc. of AIMME, vol. 13, 1961, Earhart & Griffin, Interscience Pub., N.Y. pp. 69–73, 90 and 91.

*Primary Examiner*—Walter R. Satterfield
*Attorney, Agent, or Firm*—Melville, Strasser, Foster & Hoffman

[57] ABSTRACT

A method of cold-working and stress-relieving iron-chromium ferritic stainless steels of non-heat hardenable type in the AISI 400 series, thereby increasing the ultimate tensile strength while maintaining good tensile ductility. Cold-working is effected by peripherally contacting the steel, i.e., extruding and/or die drawing, to produce a "cellular structure" not attainable in cold rolling. Repetitive cold-working and stress-relief anneals between about 750° and 1200° F increase the ultimate tensile strength in increments and restore the tensile ductility substantially to that of the hot rolled and annealed material, while maintaining the tensile to yield ratio substantially constant. Ultimate tensile strength up to about 400 ksi in small diameter wire is attainable.

4 Claims, 1 Drawing Figure

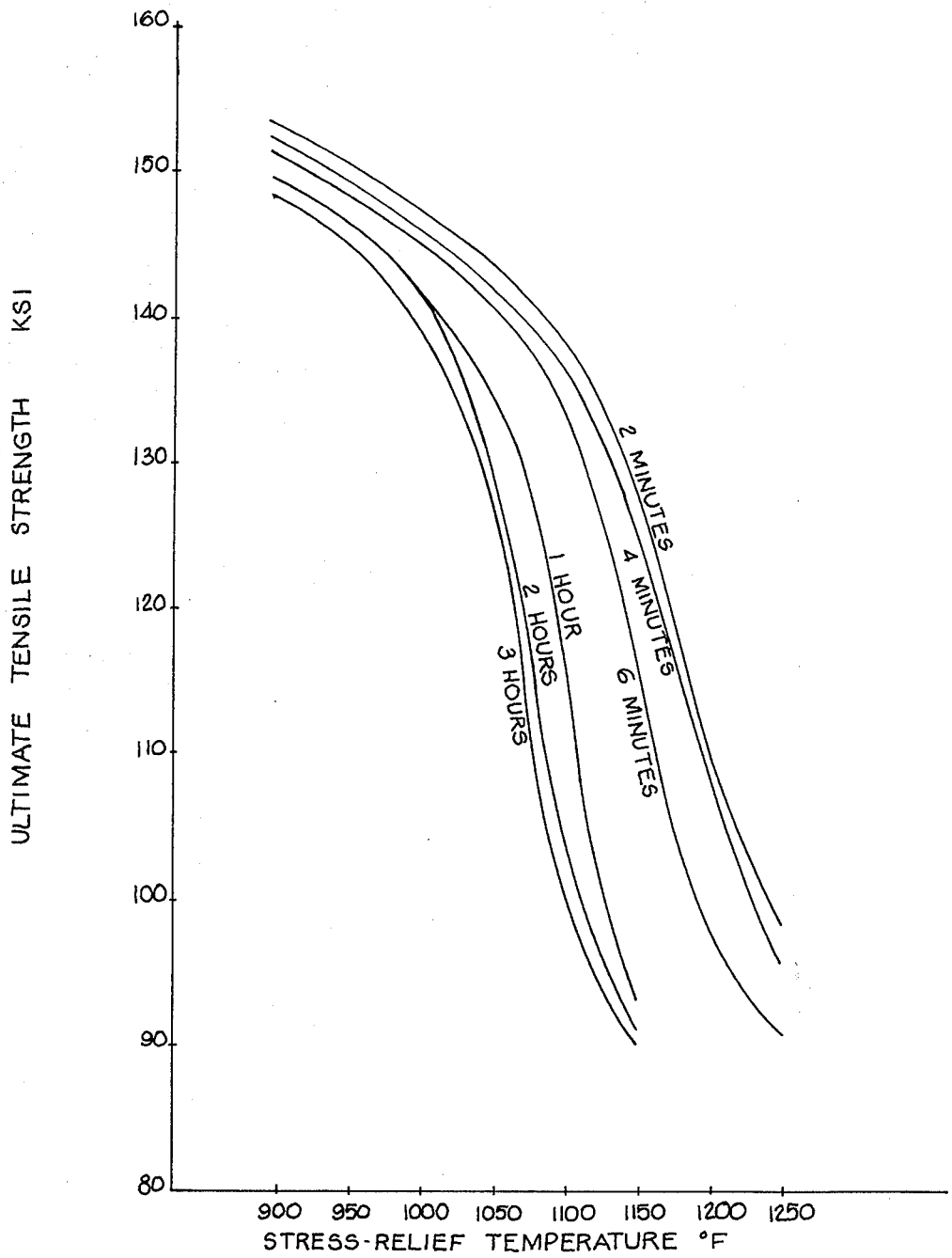
ULTIMATE TENSILE STRENGTH KSI
160
150
140
130
120
110
100
90
80
2 MINUTES
4 MINUTES
6 MINUTES
1 HOUR
2 HOURS
3 HOURS
900 950 1000 1050 1100 1150 1200 1250
STRESS-RELIEF TEMPERATURE °F

PROCESS FOR COLD-WORKING AND STRESS-RELIEVING NON-HEAT HARDENABLE FERRITIC STAINLESS STEELS

This is a division of application Ser. No. 434,397, filed Jan. 18, 1974 now U.S. Pat. No. 3,888,119.

BACKGROUND OF THE INVENTION

1. Field of the Invention

This invention relates to a process of cold-working and stress-relieving ferritic stainless steels containing about 11 to about 30% chromium of non-heat hardenable type by extrusion and/or die drawing to produce bar, rod, wire, strip and special shapes having acceptable ductility at tensil strength levels substantially greater than that of the hot-worked and annealed starting material. Steels which may be treated by the process of the present invention include AISI Types 400, 409, 410-low carbon + low nitrogen, 429, 430, 433, 434, 435, 436, 442 and 446.

2. Description of the Prior Art

Conventional annealing practices for ferritic stainless steels are intended to condition the steel for additional reduction in thickness and/or cross-section, i.e., to develop a capability for further cold-work processing. The degree of cold reduction is based on starting thickness and/or cross-section relative to the final gauge, with no predetermined or desired level of maximum mechanical strength in any stage. In other words, prior art processing is intended to produce an annealed final product which can thereafter be shaped. The mechanical strength of the shaped product approximates that of the starting material in the annealed condition.

U.S. Pat. No. 3,141,800, issued July 21, 1964to A. T. Reichenbach, discloses a method of producing dimensionally stable plates of ferritic stainless steel, wherein hot rolled, annealed and pickled blanks are cold reduced about 18 to about 35% in thickness to final gauge, annealed between about 1350° and 1450° F, pickled, flattened by stretch leveling, roller leveling or temper rolling, and stress relieved by heating between 300° and 800° F. The final stress relief treatment is stated to be critical in order to avoid shrinkage resulting from cyclic high pressure loading at elevated temperatures. Apparently the stress relief removes some directionality in mechanical properties resulting from the flattening of the plates.

U.S. Pat. No. 3,490,956, issued Jan. 20, 1970 to J. W. Wilton, discloses a process for reducing ribbing and roping of ferritic stainless steels when subjected to a deep drawing operation. A hot rolled, annealed and pickled ferritic steel is initially cold reduced from 40 to 80% in thickness, annealed at 1600° to 2100° F in a protective atmosphere, cold reduced to final thickness, and annealed at 1450° to 1600° F in a protective atmosphere. Typical ultimate tensile strengths for material processed in accordance with this patent ranged from 81.5 to 86.4 ksi, with elongations ranging from 23 to 25.5%. Typically the tensile strength of a hot rolled and annealed ferritic stainless steel of the type disclosed in this patent would be about 80 to 85 ksi. Hence, the ultimate tensile strength of the final product is substantially the same as that of the hot reduced and annealed material.

U.S. Pat. No. 3,694,271, issued Sept. 26, 1972 to L.O. Egnell discloses a method of producing a composite article consisting of a supporting layer of austenitic stainless steel bonded at least on one side to an outer layer of ferritic stainless steel. A composite billet is cold reduced, e.g. by drawing, rolling and/or bending, with a reduction in cross sectional area of 5 to 70%, and subjected to an anneal at 650° to 950° C (1202° to 1742° F) in order to recrystallize the ferrite layer. The extent of cold reduction of each layer of the composite is not defined, and the heat treatment affects only the ferritic steel portion. It is stated that the cold working increases the yield strength and creep strength of the austenitic portion drastically, and the subsequent heat treatment is intentionally controlled in order to avoid reducing the increased mechanical strength imparted to the austenitic portion by cold working. Accordingly, the austenitic portion would not possess sufficient ductility to permit further cold reduction under practicable processing conditions.

A number of earlier patents relate to the problem of preventing roping, ribbing and/or ridging in the deep drawing of ferritic steels. In general these patents disclose that composition and heat treatment of the hot reduced product are important and that annealing of the cold worked product at temperatures of about 1350° to about 1550° F is necessary in order to obtain good ductility. Representative prior art disclosures of this type include U.S. Pat. Nos. 2,772,992, issued Dec. 4, 1956 to G.C. Kiefer et al.; 2,808,353, issued Oct. 1, 1957 to W.B. Leffingwell et al.; 2,851,384, issued Sept. 9, 1958 to J.H. Waxweiler; 3,067,072, issued Dec. 4, 1962 to W.B. Leffingwell et al.; and 3,128,211, issued Apr. 7, 1964 to J.H. Waxweiler.

To the best of applicant's knowledge, the prior art neither discloses nor suggests the possibility of substantially increasing the mechanical strength of non-heat hardenable ferritic stainless steels while at the same time retaining sufficient ductility to permit subsequent cold-work forming, e.g. cold heading operations and production of spring-temper wire.

There is a definite need for ferritic stainless steels having an ultimate tensile strength up to about 310 ksi along with 18% tensile ductility, cold headability at ultimate tensile strengths of about 120 to about 140 ksi, and spring-temper characteristics equivalent to those of AISI Type 302 spring wire, for application in products such as automotive thermostat springs, windshield wiper arms, automotive fasteners and straight pins.

SUMMARY

It is a principal object of the present invention to provide a process for increasing the ultimate tensile strength of non-heat hardenable ferritic stainless steels to any desired level between about 100 and about 400 ksi while at the same time retaining sufficient ductility to permit subsequent cold-forming operations thereon.

It is a further object of the invention to provide articles of manufacture such as cold-headed fasteners, spring-temper wire and the like composed of a non-heat hardenable ferritic stainless steel having high ultimate tensile strengths.

The present invention constitutes a discovery that a non-heat hardenable stainless steel can be drastically cold reduced by extrusion and/or die drawing followed by a stress relief treatment at temperatures between about 750° and 1200° F for a period of time of from 2 minutes to 3 hours, to effect a rapid rate of recovery of tensile ductility and a slow rate of decrease in ultimate tensile strength. Repetitive cold-working and stress-relieving make it possible to increase the ultimate tensile strength in increments, from the ultimate tensile strength of the hot-reduced and annealed starting material upwardly to any desired level between about 100 ksi to about 400 ksi or higher.

The steels to which the process of the present invention is applicable include those non-heat hardenable ferritic stainless steels containing from about 11 to about 30% chromium, up to about 0.1% carbon, up to about 1% manganese, with optional additions of ferrite-forming elements which do not induce heat-hardening, e.g. about 1.5% molybdenum (AISI 434); about 0.25% aluminum, (AISI 405); about 0.50% titanium, (AISI 409); about 0.30% columbium (AISI 439); and other elements such as tungsten, vanadium, zirconium, silicon and the like. Austenite-forming elements such as nickel, cobalt, carbon, manganese and nitrogen should be restricted to relatively low levels, such as a maximum of 2% nickle as in AISI 431.

The balance is iron together with incidental impurities.

Moylbdenum may be added in amounts up to about 4% by weight, for enhanced corrosion resistance.

Accordingly, the invention is broadly applicable to the AISI Type 400 series of non-heat hardenable stainless steels having a maximum 1900°F quenched-hardness of Brinell 250. This definition is intended to exclude AISI Types 410, 420, 440 and quasi-ferritic compositions.

The minimum degree of reduction is thickness and/or cross-sectional area effected by extrusion and/or die-drawing does not constitute a limitation on the practice of the invention and is selected on the basis of the desired strength of the final product and the starting size of the hot reduced and annealed material. Ordinarily a reduction of greater than 50% up to about 95% in thickness will be effected. Similarly, the selection of a stress-relieving temperature and time at temperature will be predicated on the service requirements for the final product. Broadly, the temperature ranges from about 750° to 1200°F (preferably from 850° to 1150° F) and the time from about 2 minutes to about 3 hours (preferably ½ hour to 2 hours).

BRIEF DESCRIPTION OF THE DRAWING

Reference is made to the accompanying drawing which constitutes a graphic illustration of the influence of time and temperature on the ultimate tensile strength of an AISI Type 430 ferritic stainless steel treated in accordance with the process of the invention.

DESCRIPTION OF THE PREFERRED EMBODIMENTS

A series of tests has been conducted on AISI Type 430 and Type 431 Modified steels, the starting material being rod stock varying in diameter from 0.250 inch to 0.800 inch. The condition of the hot reduced starting material is not significant in the process of the present invention. The structure thereof is a mechanically strained ferrite.

The compositions of the steels subjected to testing are set forth in Table I below.

TABLE I

| AISI Type | Heat No. | Compositions in Weight Percent | | | | | | |
|---|---|---|---|---|---|---|---|---|
| | | C | Mn | P | S | Si | Cr | Ni |
| 430 | 762 | .061 | .52 | .03 | .02 | .60 | 16.88 | .55 |
| 431 (Modif) | 373 | .056 | .34 | .02 | .01 | .45 | 17.82 | 1.36 |
| 430 | 902 | .096 | .81 | .02 | .02 | .33 | 17.54 | .32 |

and balance iron, except for incidental impurities. The test conditions and strength and ductility properties are set forth in Tables II – V below. It will be noted that a reduction in diameter of about 50% resulted in an increase in ultimate tensile strength ranging between about 50 and 70 ksi, and each cold reduction drastically reduced the tensile ductility as measured in percent elongation (Sample length 4 times diameter). However, when subjected to a stress-relieving anneal in accordance with the process of the invention, the percent elongation was at least partially restored and was in no instance less than about 15% after stress-relieving. In most instances, the percent elongation after the stress-relieving anneal was at least about 20%. This provided ductility for subsequent cold-forming operations.

In addition, it will be observed that the tensile-yield ratio was substantially equivalent to that after the first cold drawing.

Helical springs were wound the 0.050 inch diameter wire of Step 5 in Table II, and these springs exhibited room temperature elastic properties equivalent to those of cold drawn stress-relieved springs fabricated from AISI Type 302, which had an ultimate tensile strength of 280 ksi, and slightly inferior properties to springs made from a precipitation hardenable stainless steel sold under the Registered Trademark ARMCO 17-7 P H, in the CH 900 condition with an ultimate tensile strength of 295 ksi.

The copper-coated 0.110 inch diameter wire coils resulting from process Steps 2,3 and 4 of Table IV were cold headed into Phillips recessed-head fastener blanks. Excellent headability was exhibited by the wire at each of the three levels of ultimate tensile strength, i.e., 140.9, 131 and 122 ksi, respectively. No undue loading of the heading machine was apparent, and cold-shearing of the fastener blanks proceeded without incident.

TABLE II

| Wire Diameter (Inch) | Process Step No. | Condition Of Wire | Type 430 - Heat 762 Room Temperature Mechanical Properties | | | | | |
|---|---|---|---|---|---|---|---|---|
| | | | U.T.S. (ksi) | 0.2% Tensile Y.S.(ksi) | % Elongation (4 × D) | % Red'n. in Area | Proportional Limit (ksi) | Tensile/Yield Ratio |
| .250 | 1 | Hot rolled (HR) | 90 | — | 20.0 | 56.0 | — | — |
| .110 | 2 | Cold drawn (CD) from Step 1 | 169 | 151 | 13.3 | 49.3 | — | 1.12 |
| .110 | 3 | Step 2 + annealed (Ann) 1000° F, 2 hrs, air cooled (AC) | 159.3 | 146.5 | 24.4 | 55.6 | 115 | 1.08 |
| .050 | 4 | CD from Step 3 | 226 | 220 | 3.0 | — | — | 1.03 |
| .050 | 5 | Step 4 + Ann 800° F, 1 hr,AC | 223 | 202.6 | 20.0 | 38.9 | 135 | 1.10 |
| .050 | 6 | Step 4 + Ann 850° F, 1 hr,AC | 204 | 179 | 27.0 | 36.0 | 132 | 1.14 |

TABLE II-continued

| Wire Diameter (Inch) | Process Step No. | Condition Of Wire | Type 430 - Heat 762 Room Temperature Mechanical Properties U.T.S. (ksi) | 0.2% Tensile Y.S.(ksi) | % Elongation (4 × D) | % Red'n. in Area | Proportional Limit (ksi) | Tensile/Yield Ratio |
|---|---|---|---|---|---|---|---|---|
| .050 | 7 | Step 4 + Ann 900° F, 1 hr,AC | 202 | 182 | 20.0 | 39.0 | 137 | 1.11 |
| .050 | 8 | Step 4 + Ann 950° F, 1 hr,AC | 192 | 174 | 30.0 | 40.4 | 130 | 1.10 |
| .050 | 9 | Step 4 + Ann 1000° F,1 hr,AC | 186 | 173 | 32.5 | 48.3 | 126 | 1.08 |
| .050 | 10 | Step 4 + Ann 1050° F,1 hr,AC | 171 | 165 | 35.0 | 53.4 | 121 | 1.04 |
| .050 | 11 | Step 4 + Ann 1100° F,1 hr,AC | 147 | 142 | 40.0 | 57.3 | 109 | 1.04 |

TABLE III

| Wire Diameter (Inch) | Process Step No. | Condition Of Wire | Type 430 - Heat 762 Room Temperature Mechanical Properties U.T.S. (ksi) | 0.2% Tensile Y.S.(ksi) | % Elongation 4 × D) | % Red'n- In Area | Proportional Limit (ksi) | Tensile/Yield Ratio |
|---|---|---|---|---|---|---|---|---|
| .800 | 1 | HR-Ann | 77 | 44 | 31.0 | 68.0 | — | 1.75 |
| .525 | 2 | CD from Step 1 | 112 | 102 | 16.0 | 56.0 | — | 1.10 |
| .525 | 3 | Step 2 + Ann 1025° F,3 hrs,AC | 101 | 92 | 29.0 | 60.0 | — | 1.10 |
| .262 | 4 | CD from Step 3 | 151 | 135.8 | 17.0 | 48.0 | — | 1.11 |
| .262 | 5 | Step 4 + Ann 800° F,1 hr,AC | 147 | 134.2 | 21.0 | 48.2 | 112 | 1.09 |
| .262 | 6 | Step 4 + Ann 1000° F,1 hr,AC | 133 | 120 | 24.0 | 55.0 | 102 | 1.11 |
| .130 | 7 | CD from Step 6 | 202 | — | 5.0 | 39.0 | — | — |
| .130 | 8 | Step 7 + Ann 1000° F,1 hr.,AC | 187 | 168 | 27.0 | 55.0 | 124 | 1.11 |
| .062 | 9 | CD from Step 8 | 260.8 | — | 3.0 | 40.0 | — | — |
| .062 | 10 | Step 9 + Ann 1000° F,1 hr,AC | 246 | 224 | 24.0 | 52.0 | 140 | 1.10 |
| .030 | 11 | CD from Step 10 | 314 | — | 3.0 | 38.0 | — | — |
| .030 | 12 | Step 11 + Ann 800° F, 1hr,AC | 308 | 272 | 18.0 | 48.0 | 155 | 1.13 |

TABLE IV

| Wire Diameter (Inch) | Process Step NO. | Condition Of Wire | Type 430 - Heat 762 Room Temperature Mechanical Properties U.T.S. (ksi) | 0.2% Tensile Y.S.(ksi) | % Elongation (4 × D) | % Red'n. in Area | Proportional Limit (ksi) | Tensile/Yield Ratio |
|---|---|---|---|---|---|---|---|---|
| .250 | 1 | HR | 90 | — | 20.0 | 56.0 | — | — |
| .110 | 2 | CD from Step 1 + Ann 1075° F, 1½ hrs, AC flash-pickled & Cu coat | 140.9 | 132.2 | 20.4 | 58.6 | — | 1.14 |
| .110 | 3 | CD from Step 1 + Ann 1100° F, 1½ hrs, AC flash-pickled & Cu coat | 131 | 115.75 | 28.9 | 59.0 | — | 1.13 |
| .110 | 4 | CD from Step 1 + Ann 1150° F, 1½ hrs, AC flash-pickled & Cu coat | 122 | 108 | 34.0 | 61.0 | — | 1.13 |

TABLE V

| Wire Diameter (Inch) | Process Step No. | Condition Of Wire | Type 431 Modified - Heat 373 Room Temperature Mechanical Properties U.T.S. (ksi) | 0.2% Tensile Y.S.(ksi) | % Elongation (4 × D) | % Red'n. in Area | Proportional Limit (ksi) | Tensile/Yield Ratio |
|---|---|---|---|---|---|---|---|---|
| .375 | 1 | HR-Ann | 85.5 | — | 33.0 | — | — | — |
| .187 | 2 | CD from Step 1 | 151 | 135 | 17.0 | 49.0 | — | 1.12 |
| .187 | 3 | Step 2 + Ann 1025° F,2 hrs,AC | 133.7 | 121 | 25.0 | 56.0 | — | 1.10 |
| .080 | 4 | CD from Step 3 | 198 | 174 | 8.0 | 42.0 | — | 1.13 |
| .080 | 5 | Step 4 + Ann 800° F, 1 hr,AC | 196.4 | 184.3 | 15.6 | 44.9 | 129 | 1.06 |
| .080 | 6 | Step 4 + Ann 900° F, 1 hr,AC | 184.3 | 175.3 | 18.8 | 48.6 | 129 | 1.05 |

From the data of the preceding Tables, it has been found that optimum results are obtained under the following conditions:

A — Stress-relief at 950° to 1150° F for 1 to 2 hours to produce the following properties:

single reduction — ultimate tensile strength > 100 ksi — elongation (4 × D) > 20% mulitple reductions — ultimate tensile strength > 130 ksi — elongation (4 × D) > 24%

B — Stress-relief at 1075° F to 1150° F for 1 to 2 hours to produce the following properties:

single reduction — ultimate tensile strength > 120 ksi — elongation (4 × D) > 28% multiple reductions — ultimate tensile strength > 145 ksi — elongation (4 × D) > 40%

The above conditions are set forth by way of example as preferred but non-limiting procedures.

The foregoing Tables also set forth proportional limit values for a number of samples. Proportional or elastic limit is a measure of the capacity of a fabricated article, such as a spring, to be mechanically loaded by service stresses without undergoing permanent damage which would destroy serviceability. For spring-temper applications a higher proportional limit is thus associated with greater efficiency in service and design. AISI Type 301 spring-temper wire at 280 ksi ultimate tensile strength exhibits a proportional limit of 20 to 30 ksi; Armco 17-7 PH at 280 ksi ultimate tensile strength exhibits a proportional limit of about 105 ksi; AISI Type 430 processed in accordance with the present invention to 280 ksi ultimate tensile strength exhibits a proportional limit of 125 ksi, and at 300 ksi ultimate tensil strength exhibits a proportional limit of 135 ksi. The proportional limit increases directly with ultimate tensile strength in Type 430, which is not true of Type 301 or Armco 17-7 PH.

Ordinarily, AISI Type 430 is cold headed from an ultimate tensile strength of 80 ksi into fastener blanks such as the Phillips-type recessed-head fastener. It has therefore been necessary in the past to utilize an austenitic chromium-nickel stainless steel in order to obtain cold headed fasteners having ultimate tensile strengths of greater than about 120 ksi. It will be apparent that the present process projects non-heat hardenable ferritic stainless steels into applications now fulfilled only by the much more expensive austenitic chromium-nickel stainless steels.

It has been found that conventional cold rolling mill reduction of ferritic stainless steels in strip and sheet form results in a product which does not respond to stress-relief annealing in the same manner as a starting material which has been extruded and/or drawn through peripherally contacted dies. Although not wishing to be bound by theory, it is believed that the extrusion and/or die drawing develop a "cellular structure" within the cross-section of the cold worked product which is not obtained in cold rolled strip and sheet having a width many times its thickness. The metallurgical reactions operative in stress-relief are believed to include partial recovery from the prior cold work by the annealing out of vacancies and/or rearrangement of dislocation pile-ups (without complete relaxation of the prior cold worked structure), slow growth of the cells or sub-grains formed during cold work, and recrystallization.

The data of Table V show that a modified Type 431 containing 1.36% nickel responded to the process of the present invention in the same manner as regular AISI Type 430. Here again, it was observed that the percent elongation was restored to an adequate level by reason of the stress-relief anneal.

By way of comparison, an AISI Type 302 wire was cold drawn to 0.262 inch diameter from a 0.5 inch starting material, annealed at 850°F for 1 hour and air cooled. The 0.262 inch diameter wire exhibited an ultimate tensile strength of 175 ksi, a 0.2 tensile yield strength of 143 ksi, a percent elongation (4×D) of 9.0, a percent reduction in area of 52.0, a proportional limit of 70 ksi and a tensile/yield ratio of 1.22.

A Type 302 spring wire was cold drawn to 0.080 inch diameter from a 0.19 inch starting material, annealed at 850°F for 1 hour and air cooled. It exhibited an ultimate tensile strength of 255 ksi, 0.2% tensile yield strength of 240 ksi, percent elongation (4×D) of 2.0, a proportional limit of 70 ksi and a tensile-yield ratio of 1.06.

The extremely low ductility of Type 302 when treated under similar conditions thus contrasts sharply with the good ductility values of the ferritic stainless steels when treated by the process of this invention.

The drawing illustrates graphically the influence of time and temperature in the stress-relief anneal between 900° and 1250° F. These curves were plotted from test data on heat 902 of Table I for a wire cold drawn to 0.051 inch diameter with an ultimate tensile strength of 153 ksi. It will be noted that a stress-relief temperature above 1200°F results in an ultimate tensile strength of less than 100 ksi even if the time at temperature is limited to less than 5 minutes. Accordingly, the maximum temperature of 1200°F is considered to be critical in the process of the present invention. It is further apparent that lower temperatures in the range of 900° to 1100° F can be utilized even up to 3 hours without reducing the ultimate tensile strength to less than 100 ksi.

TABLE VI

Type 430 - Heat 762
Time and Temperature Relation to Room Temperature Mechanical Properties

| Condition | U.T.S. (ksi) | 0.2% Tensile Y.S.(ksi) | % Elongation (4 + D) | % Red'n. in Area | Tensile/Yield Ratio |
|---|---|---|---|---|---|
| .100 inch diameter CD from .250 in diameter HR rod | 172 | 146 | 7.5 | 48.0 | 1.18 |
| CD .100" + Ann 700° F, ½hr,AC | 171 | 150 | 12.0 | 50.0 | 1.14 |
| CD .100" + Ann 700° F, 1 hr. AC | 170.2 | 148 | 20.0 | 50.0 | 1.15 |
| CD .100" + Ann 800° F, ½ hr,AC | 167.2 | 149 | 13.0 | 50.0 | 1.12 |
| CD .100" + Ann 800° F, 1 hr,AC | 165 | 149.4 | 22.5 | 50.0 | 1.10 |
| CD .100" + Ann 900° F. ½ hr,AC | 165 | 148.6 | 15.0 | 50.0 | 1.10 |

TABLE VI-continued

| Type 430 - Heat 762 Time and Temperature Relation to Room Temperature Mechanical Properties | | | | | |
|---|---|---|---|---|---|
| Condition | U.T.S. (ksi) | 0.2% Tensile Y.S.(ksi) | % Elongation (4 + D) | % Red'n. in Area | Tensile/Yield Ratio |
| CD .100", Ann 900° F, 1 hr,AC | 163 | 146.8 | 25.0 | 52.8 | 1.11 |
| CD .100", Ann 1000° F, ½ hr,AC | 160.5 | 146 | 19.0 | 51.0 | 1.10 |
| CD .100", Ann 1000° F, 1 hr,AC | 155.2 | 144.2 | 27.5 | 55.6 | 1.08 |

Additional data showing the influence of time and temperature on other mechanical properties is set forth in Table VI above. From these data and those of the preceeding Tables II–V, it will be apparent that the process of the invention provides an increase in tensile strength of at least about 50 ksi for each 50% reduction in thickness, and that the stress-relieving treatment within a range of about 750° to 1200° F with a time at temperature of about 2 minutes to about 2 hours achieves an elongation value (at least about 15%) adequate to permit subsequent cold forming operations. The graph of the drawing indicates that time at temperature should be varied inversely with temperature.

Wire and rod sections of 0.262 inch diameter and greater were cold drawn with single-stand drawing arrangements. This type of processing required a relatively slower rate of cross-sectional reduction than that obtainable with multiple-die, cold-drawing operations. Accordingly, the process of the invention appears to find greatest utility in the production of stainless steel wire sections and/or special shapes in final sizes less than 0.220 inch diameter.

As indicated above, the condition of the starting material does not constitute a limitation. The present process can be applied to annealed, hot rolled or quench-hardened mill sections which have been melted, cast and hot reduced in accordance with conventional practice. Typical starting conditions include hot rolled; hot rolled and stress relieved at temperatures below about 1300° F; hot rolled and annealed at temperatures above 1300° and below 1700° F; and hot rolled and quench-hardened from temperatures higher than 1700° F.

Novel products of the present invention include cold headed fastener blanks having an ultimate tensile strength of at last about 125 ksi, helical springs having an ultimate tensile strength of at least about 200 ksi, cold worked and stress-relieved bar, rod, wire, strip and special shapes having ultimate tensile strengths ranging from about 125 to about 300 ksi and sufficient ductility to permit subsequent cold forming operations, all fabricated from a non-heat hardenable ferritic stainless steel having a composition as hereinabove defined.

Modifications may be made in the invention without departing from the spirit and scope thereof. Accordingly, no limitations are to be inferred or intended other than as set forth in the appended claims.

The embodiments of the invention in which an exclusive property or privilege is claimed are defined as follows:

1. Cold worked and stress-relieved bar, rod and wire, having ultimate tensile strengths ranging from about 125 to about 300 ksi and a percent elongation (sample length 4 times diameter) of not less than 15%, formed by cold reducing at least 50% in thickness and stress-relieving a non-heat hardenable ferritic stainless steel consisting essentially of, by weight percent, from about 11 to about 30% chromium, up to about 0.1% carbon, up to about 1% manganese, and balance iron.

2. cold worked and stress-relieved bar, rod, and wire, as claimed in claim 1, wherein said ferritic stainless steel additionally contains up to about 4% molybdenum, up to about 0.25% aluminum, up to about 0.50% titanium, up to about 0.30% columbium, or up to about 2% nickel.

3. cold headed fastener blanks having an ultimate tensile strength of at least about 125 ksi and a percent elongation (sample length 4 times diameter) of not less than 15%, fabricated from a cold reduced and stress-relieved non-heat hardenable ferritic stainless steel consisting essentially of, by weight percent, from about 11 to about 30% chromium, up to about 0.1% carbon, up to about 1% manganese and balance iron.

4. Helical springs having an ultimate tensile strength of at least about 200 ksi and a precent elongation (sample length 4 times diameter) of not less than 15%, fabricated from a repetitively cold reduced and stress-relieved non-heat hardenable ferritic stainless steel consisting essentially of, by weight percent, from about 11% to about 30% chromium, up to about 0.1% carbon, up to about 1% manganese, and balance iron.

* * * * *